US006811193B2

(12) United States Patent
Arabia, Jr. et al.

(10) Patent No.: US 6,811,193 B2
(45) Date of Patent: Nov. 2, 2004

(54) QUIET VEHICLE DOOR LATCH

(75) Inventors: Frank J. Arabia, Jr., Macomb, MI (US); Donald M. Perkins, Sterling Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/411,445

(22) Filed: Apr. 10, 2003

(65) Prior Publication Data

US 2004/0007882 A1 Jan. 15, 2004

Related U.S. Application Data

(60) Provisional application No. 60/394,838, filed on Jul. 10, 2002.

(51) Int. Cl.[7] ..... E05C 3/06

(52) U.S. Cl. ..... 292/216; 292/DIG. 61

(58) Field of Search ..... 292/216, 201, 292/DIG. 23, DIG. 61, DIG. 56

(56) References Cited

U.S. PATENT DOCUMENTS 4,434,635 A * 3/1984 Borgato ..... 70/279.1
4,880,263 A * 11/1989 Yamada ..... 292/216
4,971,373 A * 11/1990 Hamada et al. ..... 292/216
5,277,461 A 1/1994 Dzurko et al.
6,053,543 A 4/2000 Arabia, Jr. et al.
6,062,613 A * 5/2000 Jung et al. ..... 292/201
6,123,372 A 9/2000 Rogers, Jr. et al.
6,199,923 B1 3/2001 Rice et al.
6,406,075 B1 6/2002 Rice et al.
6,422,619 B1 7/2002 Arabia, Jr. et al.
6,435,575 B1 8/2002 Pajak et al.
6,511,106 B2 1/2003 Perkins et al.
6,517,128 B2 2/2003 Perkins et al.
6,550,825 B2 4/2003 Ostrowski et al.
6,648,380 B1 * 11/2003 Szablewski et al. ..... 292/201

* cited by examiner

*Primary Examiner*—Gary Estremsky
(74) *Attorney, Agent, or Firm*—Scott A. McBain

(57) ABSTRACT

A vehicle door latch has a forkbolt that moves between a latched position and an unlatch position and a detent that moves between a detent position where the detent holds the forkbolt in the latched position and a release position where the detent releases the forkbolt for movement to the unlatch position. The vehicle door latch includes a detent spring that biases the detent toward the detent position and a release mechanism that moves the detent against the bias of the detent spring to the release position to release the forkbolt. The vehicle door latch also includes an auxiliary detent spring that decelerates the movement of the detent to the detent position under the bias of the detent spring to reduce noise when the detent strikes the fork bolt. An auxiliary counter spring and an alternative auxiliary helper spring are shown.

18 Claims, 5 Drawing Sheets

QUIET VEHICLE DOOR LATCH

RELATED APPLICATION

Benefit of provisional patent application No. 60/394,838 filed Jul. 10, 2002 is claimed.

TECHNICAL FIELD

This invention relates generally to a vehicle door latch and more particularly to a vehicle door latch that has a forkbolt, a detent for holding the forkbolt in a latched position, a release mechanism for moving the detent to a position releasing the forkbolt and a lock mechanism for disabling the release mechanism.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually.

In general terms, the door latch has a forkbolt that engages a striker in the door jamb to latch the door when it is closed and a spring biased detent that engages and holds the forkbolt in the latched position. The door latch also typically has a release mechanism for moving the detent to a position releasing the forkbolt so that the door can be unlatched and opened and a lock mechanism for disabling the release mechanism to prevent unauthorized unlatching of the door.

Door latches often use soft thermoplastic materials and bumpers to enhance the sound quality of the door latch, particularly that of the operations of the forkbolt and the detent. See for instance, U.S. Pat. No. 5,277,461 granted to Thomas A. Dzurko et al Jan. 11, 1997 for a vehicle door latch, which discloses a typical door latch of the above noted type. The door latch disclosed in the Dzurko '461 patent includes a forkbolt that has a plastic coating that covers a surface of a slot that is engaged by the striker for energy absorption and quiet operation when the door is slammed shut. The detent lever also includes a plastic coating which has a slotted portion that provides an integral bumper that engages a stop to absorb energy and quiet operation when the door is slammed shut.

Door latches of the type disclosed in the Dzurko '461 patent have been used successfully by automotive manufacturers for many years. However, there is a desire to make further improvements in the door latches of the above noted type with regard to quiet operation.

SUMMARY OF THE INVENTION

The object of this invention is to provide a vehicle door latch that is quiet in operation.

It is well known that the noise produced by the spring biased detent striking the forkbolt to engage and hold the forkbolt in the latched position is detrimental to quiet operation of the door latch, particularly the latching sound that is produced when the door is slammed shut. We have found that level of noise of the latching sound is related to the acceleration of the spring biased detent as it moves from the release position to the detent position and strikes the forkbolt under the bias of the detent spring.

The door latch of the invention has a main detent spring and an auxiliary detent spring that act in concert so the detent decelerates faster as the detent approaches the forkbolt. This softens the sound because the energy is dissipated over a larger time domain resulting in quiet operation even when the striking surfaces are metal. The auxiliary spring also results in a reduced unlatching effort without any impact in meeting performance requirements for maintaining the detent in a primary or secondary latch position.

In a preferred embodiment, the auxiliary spring takes the form of a counter spring that acts against the main detent spring during the ending portion of the detent stroke as the detent moves from the release position to the detent position. In another preferred embodiment, the auxiliary spring takes the form of a helper spring that assists the main detent spring during the initial portion of the detent stroke.

In either event, the auxiliary spring is preferably a metal spring because the performance of the metal auxiliary spring is more stable in comparison to the use of thermoplastic materials because the performance of the counter spring does not change nearly as much as the thermoplastic materials from a time and temperature perspective.

BRIEF DESCRIPTION OF THE DRAWINGS

The above and other objects, features and advantages of the invention will become apparent from the description below, which is given by way of example with reference to the accompanying drawings in which.

DESCRIPTION OF THE PREFERRED EMBODIMENT

Figure 1:
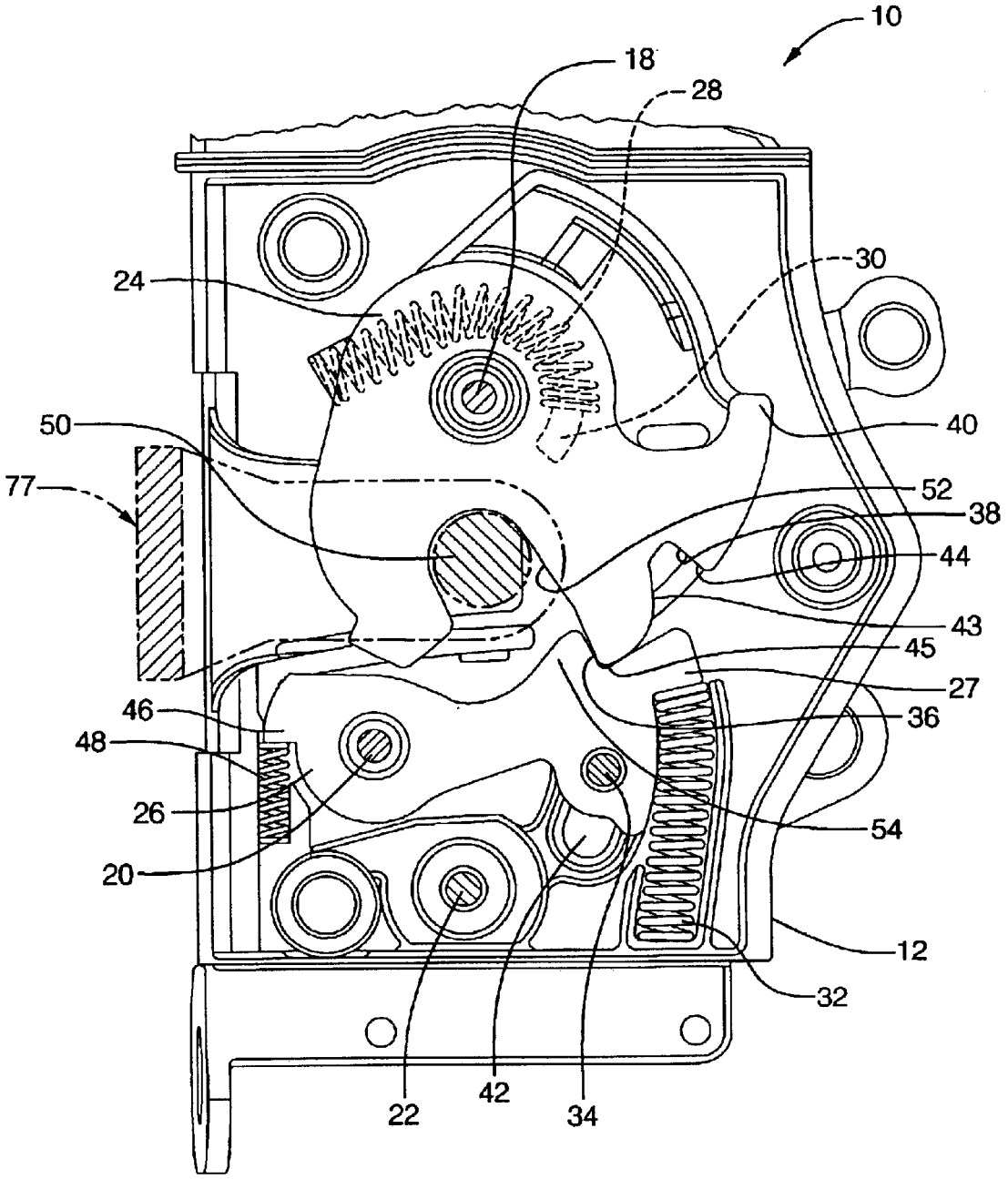
FIG. 1 is a partial front view of a vehicle door latch of a first embodiment of the invention with parts removed to show operation of the latch mechanism; specifically a fork bolt, a detent, a main detent spring and an auxiliary detent spring with the detent in a detent position (engaged) holding the fork bolt in a primary latched position.

Referring now to FIG. 1, the vehicle door latch 10 has a multi-piece enclosure that comprises plastic housing 12, a metal frame or face plate (not shown) and a plastic back cover (not shown). The plastic housing 12 and the metal face plate are held together by three flanged studs 18, 20 and 22 that are inserted through three holes in plastic housing 12, then through three aligned holes in the metal face plate and then flanged over the metal face plate to form a forward compartment.

Door latch 10 has a latch mechanism comprising a forkbolt 24 and a cooperating detent 26 that are located in the forward compartment and pivotally mounted on the forward portions of studs 18 and 20 respectively. As best shown in FIG. 1, forkbolt 24 is biased clockwise by a compression spring 28 that is disposed in a curved slot in plastic housing 12 behind forkbolt 24. Spring 28 engages a lateral lug 30 of forkbolt 24 at one end and an end wall of the curved slot at the other end. Detent 26 is biased counterclockwise into engagement with forkbolt 24 by a coil shaped, detent compression spring 32 that engages an ear 27 of detent 26 at one end. The opposite end of detent compression spring 32 engages an internal wall of housing 12.

Figure 2:
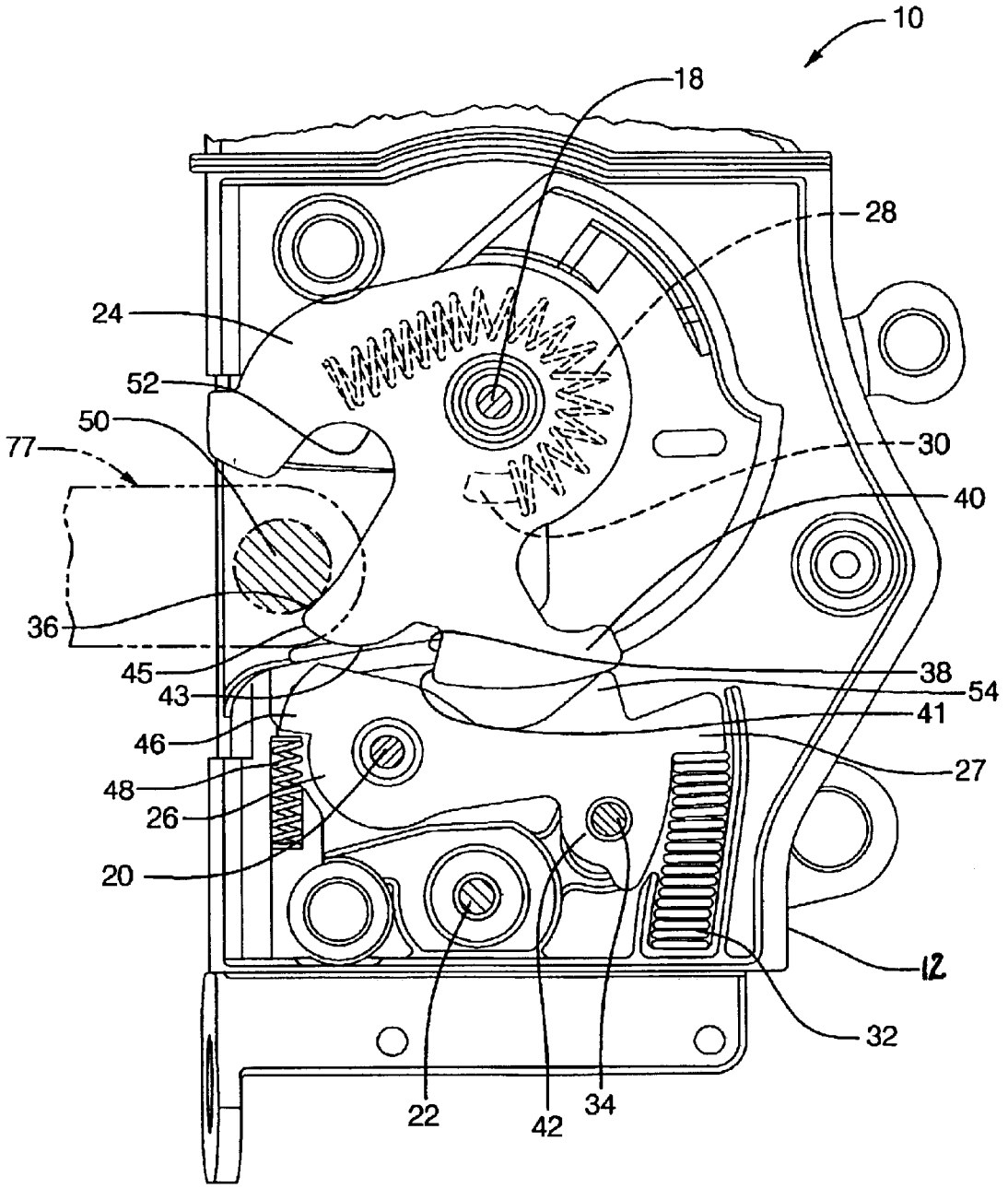
FIG. 2 is a partial front view of the vehicle door latch shown in FIG. 1 with the detent disengaged and in a release position.
Figure 3:
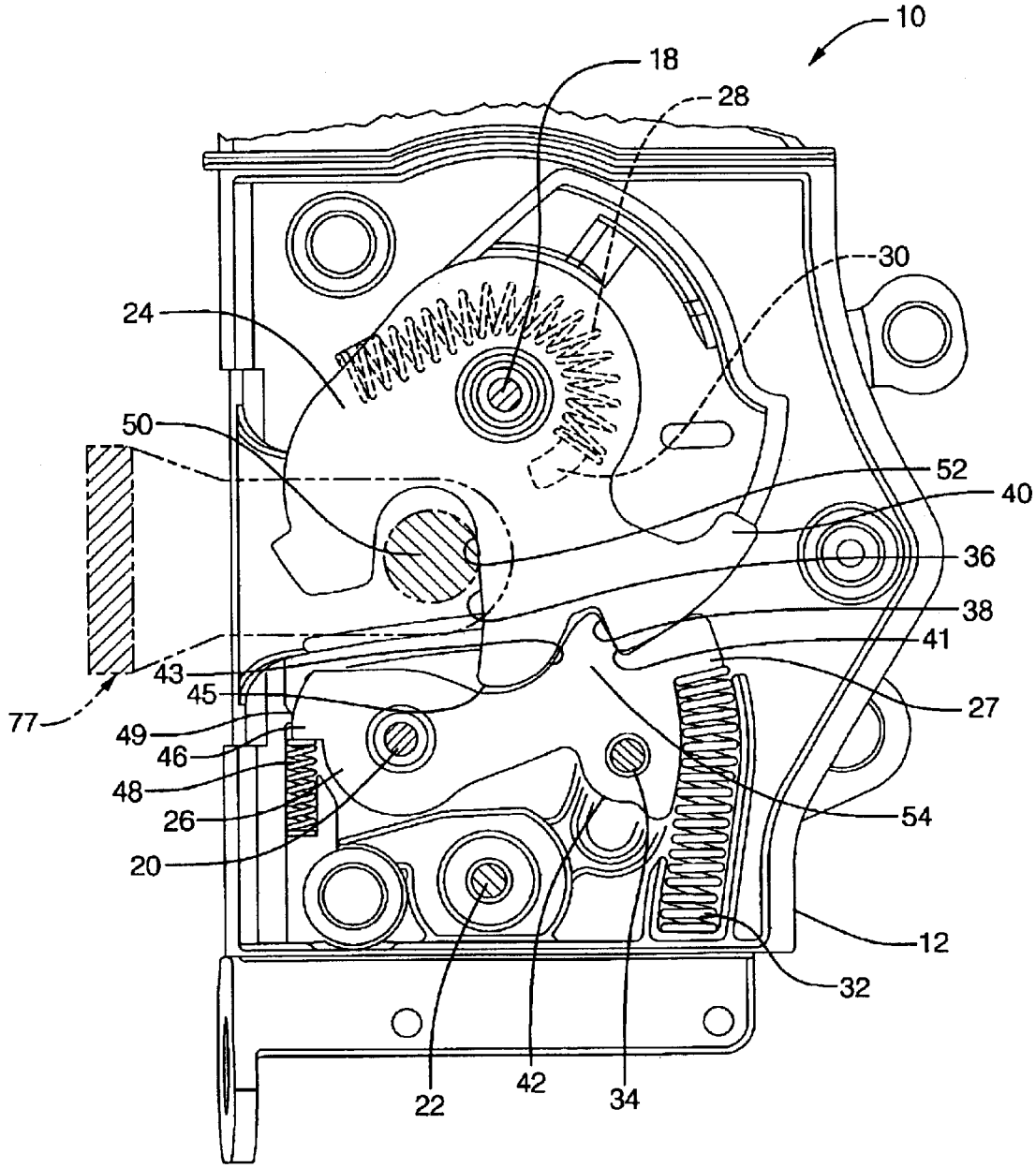
FIG. 3 is a partial front view of the vehicle door latch shown in FIG. 1 with the detent engaged holding the fork bolt in a secondary latched position.

Detent 26 engages forkbolt 24 at shoulder 36 and holds forkbolt 24 in a primary latched position against the bias of compression spring 28 as shown in FIG. 1. Detent 26 engages forkbolt 24 at foot 40 in its unlatched or release position as shown in FIG. 2. Detent 26 can also engage forkbolt 24 at shoulder 38 and hold it in an intermediate secondary latched position as shown in FIG. 3.

Detent 26 has a lateral pin 34 that extends through housing slot 42 into a rear compartment formed by plastic housing 12 and the plastic back cover (not shown). Door latch 10 has a release mechanism for releasing or unlatching the latching mechanism that is disposed in,the rear compartment. Details of the release mechanism are not shown or described because the details are not necessary for an understanding of the invention except to know that detent 26 is rotated clockwise from the latched position shown in FIG. 1 and out of latched engagement with the forkbolt 24 to a release or unlatched position shown in FIG. 2 when the latching mechanism is operated. This releases forkbolt 24 so that it is free to rotate clockwise from the latched position shown in FIG. 1 to the unlatched position shown in FIG. 2 under the bias of compression return spring 28 when the vehicle door is opened. Door Latch 10 also has a lock mechanism for disabling the release mechanism that is also located in the rear compartment defined by housing 12 and the back cover. Details of the structure and operation of the lock mechanism is not necessary for an understanding of the invention. However, for a detailed explanation of a suitable latch mechanism and lock mechanism, see U.S. Pat. No. 6,053,543 granted to Frank Joseph Arabia, Jr. et al. Apr. 25, 2000.

As thus far described, door latch 10 is already known. However, door latch 10 has an added feature in the form of an auxiliary detent spring for detent 26 that acts in concert with the main detent compression spring 32. In the preferred embodiment shown in FIGS. 1, 2 and 3, the auxiliary detent spring takes the form of a counter compression spring that acts against the main compression spring 32. More particularly, by way of example, detent 26 has a second ear 46 that is positioned to engage a coil shaped counter compression spring 48 at one end. Counter spring 48 is disposed in a slot of housing 12 and engages an end wall of the slot at the other end.

An important feature of the first embodiment of the invention is that the auxiliary counter spring 48 is spaced from second ear 46 when detent 26 is disengaged and in the release position while fork bolt 24 is in the unlatched position of FIG. 2. Main detent spring 32 is compressed to a maximum extent under these conditions and the spacing of auxiliary counter spring 48 from ear 46 avoids any reduction of torque applied to detent 26 by main detent spring 32 in the disengaged or release position of detent 26 as shown in FIG. 2 and the chart of FIG. 4. The high undiminished torque of the main detent spring 32 is maintained to initiate movement of the detent 26 toward detent position of FIG. 1 so that the door latch 10 can operate in harsh environments, for instance, corrosive environments and/or cold environments up to −50 degrees centigrade.

Auxiliary counter spring 48 is preferably spaced from second ear 46 by a stopper 49 to prevent rattle and wear of the auxiliary counter spring. On the other hand main detent spring 32 is preferably compressed slightly, i.e. pre-stressed a small amount when detent 26 is in the primary latched position of FIG. 1 or the secondary latched position of FIG. 3 to prevent rattle and wear of main detent spring 32. Counter spring 48 is at or near maximum compression at these times as shown in FIGS. 1 and 3 and in the chart of FIG. 4.

The door latch 10 described above operates as follows. When the door latch 10 is in an unlatched and unlocked condition, forkbolt 24 is poised to receive striker pin 50 as shown in FIG. 2. When the door is slammed shut, the striker pin 50 enters the throat 52 of the forkbolt 24, engages the back of throat 52 and rotates forkbolt 24 counterclockwise against the bias of compression spring 28 until forkbolt 24 is rotated to the primary latch position shown in FIG. 1 where forkbolt 24 captures striker pin 50 in throat 52. Forkbolt 24 is held in the primary, latch position by catch 54 of detent 26 engaging primary latch shoulder 36 of forkbolt 24.

As forkbolt 24 rotates counterclockwise from the unlatched position of FIG. 2 to the primary latch position of FIG. 1 catch 54 rides along the periphery of the forkbolt 24 under the full bias of main detent compression spring 32 undiminished by the counter bias of counter compression spring 48. During this travel, catch 54 rides on the foot 40 to the edge 41 of foot 40 and then snaps into engagement with the intermediate secondary latch shoulder 38. If the door is slammed shut hard enough, catch 54 continues on riding up ramp 43 to edge 45 and then snaps into engagement with the primary latch shoulder 36. Each time catch 54 snaps into engagement with one of the latch shoulders 36 or 38, some part of catch 54 strikes the periphery of fork bolt 24, for instance ear 27 striking the periphery of fork bolt 24 adjacent the latch shoulder 36 as shown in FIG. 1. In this instance, the snap motion of detent 26 is decelerated rapidly by counter spring 48 reducing the noise of the ear 27 striking the periphery of fork bolt 24 at the top of ramp 43.

Figure 4:
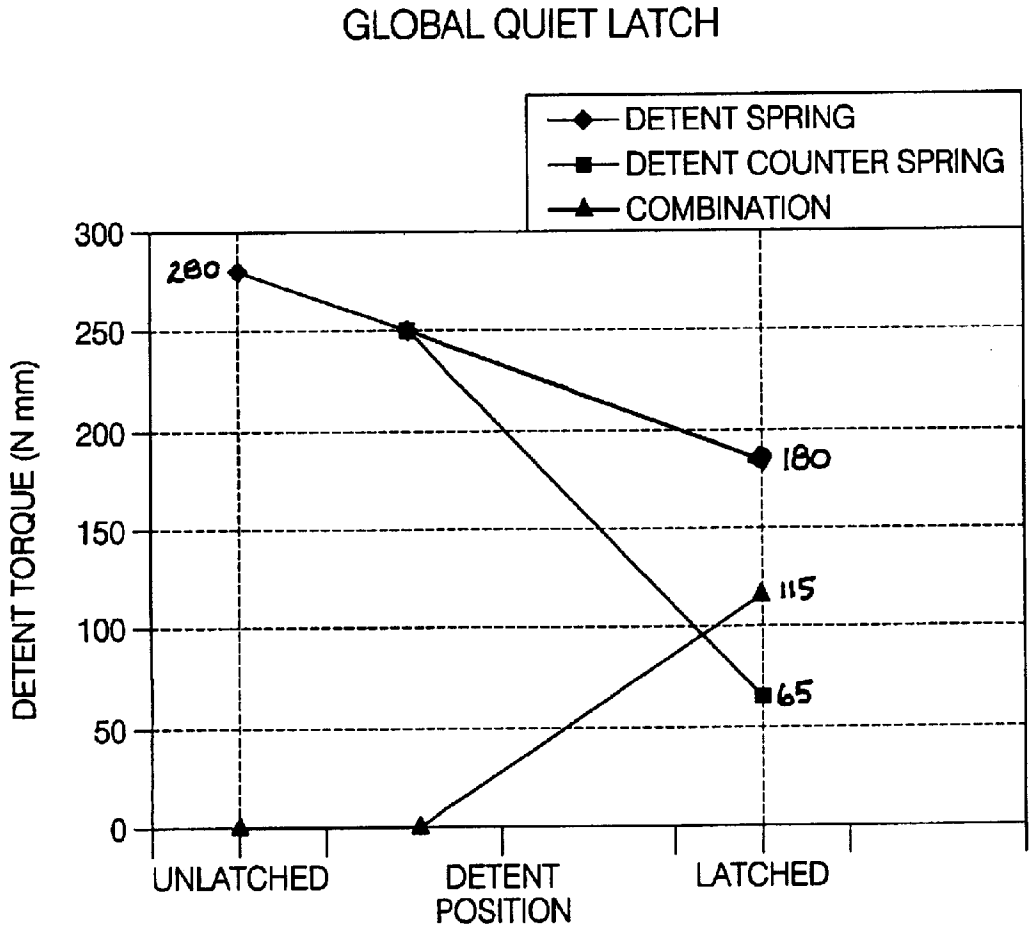
FIG. 4 is a graph showing the detent torques of the main detent spring, the auxiliary detent spring and the combination of the two springs in relation to the detent position during the detent stroke.

Referring now to the chart of FIG. 4 which shows a typical application of the invention, the detent toque applied to the detent 26 by main detent spring 32 and auxiliary detent counter spring 48 is shown in terms of the position of detent 26 as it snaps down from the unlatched position at the top edge 45 of ramp 43 to the primary latched position of FIG. 1. In this very short period of time, torque acting on detent 26 diminishes slowly at first from about 280 Newton-millimeters to about 250 Newton-millimeters. Then auxiliary detent spring 48 engages detent 26 and the torque acting on detent 26 diminishes substantially and rapidly from about 250 Newton-millimeters to about 65 Newton-millimeters (about 74%). The moving detent 26 decelerates rapidly because of the rapidly diminishing torque. Thus detent 26 strikes fork bolt 28 with relatively little speed and force thereby providing a substantially quiet operation.

As indicated above, detent counter spring 48 is spaced from detent 26 so that the torque on detent 26 diminishes slowly at first to about 250 Newton-millimeters as detent spring 32 expands. However, once counter spring 48 engages detent, the torque on detent 26 diminishes rapidly from about 250 Newton-millimeters to about 65 Newton-millimeters because the torque of detent spring 32 is diminishing as it expands while the counter torque of counter spring 48 is increasing as it is compressed. The overall effect of spacing the counter spring 48 from detent 26 when the detent is in the release position is a dual rate spring that has a low spring rate until the counter spring 48 is engaged and then a high spring rate as demonstrated by Chart 4.

The reduced torque acting on the detent 26 in the engaged position of FIG. 1 reduces the overall unlatching effort by reducing the initial unlatching effort needed to move detent 26 to the release position of FIG. 2. However the resistance to movement increases rapidly from about 65 Newton-millimeters to about 250 Newton-millimeters and then increases slowly to 280 Newton-millimeters when auxiliary counter spring 48 disengages. Consequently, while the overall unlatching effort is reduced, the counter spring 48 does not have any negative impact on the latching performance of the door latch 10. As indicated above, the high undiminished torque of the detent spring 32, 280 Newton-millimeters for example, is preferred to initiate movement of the detent so that the door latch 10 can operate in corrosive environments and/or cold environments up to −50 degrees centigrade.

Modem door latches usually include a secondary latch shoulder, such as the shoulder 38 which is engaged when the vehicle door is shut without a great deal of force. Even in this instance, the latching engagement is quiet without any negative impact on the secondary latched performance of door latch 10. By way of example, stroke of detent 26 from the unlatched position of FIG. 2 to the secondary latched position of FIG. 3 is substantially the same as the stroke of detent 26 from the unlatched position to the primary latched position described above. Thus the performance of the main detent spring 32 and the auxiliary detent counter spring 48 is the same in connection with the secondary latching operation.

Figure 5:
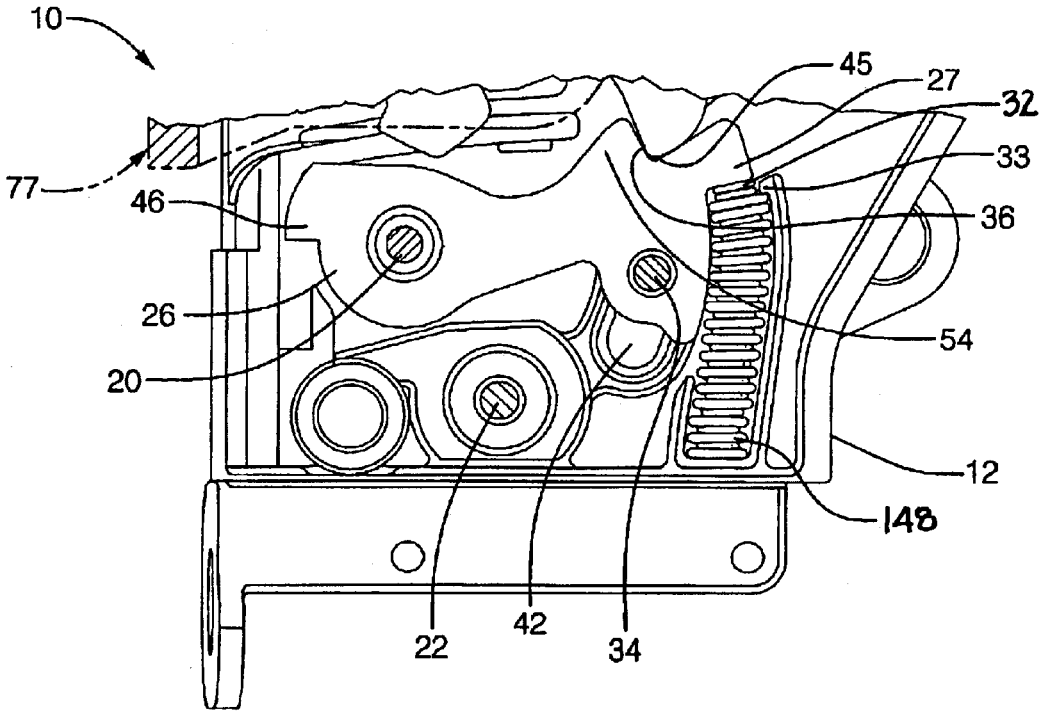
FIG. 5 is a partial front view of a vehicle door latch of a second embodiment of the invention with parts removed to show operation of the latch mechanism; specifically the fork bolt, the detent, the main detent spring and an alternative auxiliary detent spring with the detent engaged and holding the fork bolt in the primary latched position.
Figure 6:
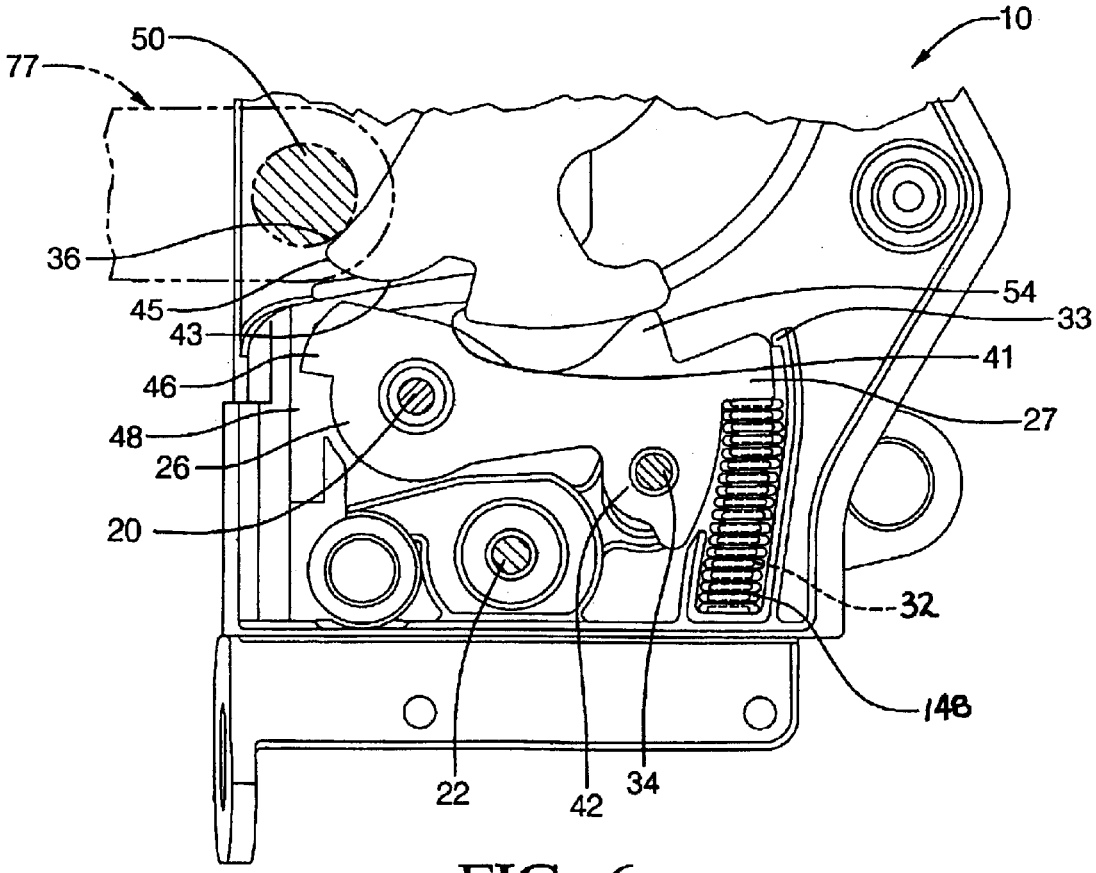
FIG. 6 is a partial front view of the vehicle door latch shown in FIG. 5 with the detent disengaged and in a release position.

Referring now to FIGS. 5 and 6 a second embodiment of the invention is disclosed. In this second embodiment, the auxiliary detent spring is in the form of a helper spring that assists the main spring. Except for the replacement of the auxiliary detent counter spring 48 by the helper spring 148, the parts of the door latch 10 disclosed in FIGS. 5 and 6 are the same as those of the door latch 10 disclosed in FIGS. 1, 2 and 3 and the corresponding parts are identified by the same reference numerals.

As indicated above in connection with the first embodiment of FIGS. 1, 2 and 3, the second embodiment of FIGS. 5 and 6 is known except for the auxiliary detent spring for detent 26 that acts in concert with the main detent compression spring 32. In the second embodiment shown in FIGS. 5 and 6, the auxiliary detent spring takes the form of a helper spring that assists the main compression spring 32. More particularly, by way of example, detent 26 has an ear 27 that is positioned to engage a coil shaped helper compression spring 148 at one end. Helper spring 148 is disposed in a slot of housing 12 in a coaxial surrounding relationship with main spring 32 and engages an end wall of the slot at the other end.

An important feature of the second embodiment of the invention is that the action of the auxiliary helper spring 148 is limited by a stop 33 that protrudes into the slot holding the auxiliary helper spring 148 so that the helper spring 148 is spaced from ear 27 when detent 26 is in the detent position and engages fork bolt 24 as shown in FIG. 6.

When the vehicle door carrying the door latch 10 is slammed shut, the fork bolt 24 is rotated from the disengaged position of FIG. 6 to the engaged position of FIG. 5 and catch 54 snaps behind the primary latch shoulder 36. When catch 54 reaches the top edge 45 of ramp 43, the main detent spring 32 and the auxiliary helper spring 148 both apply a counter clockwise toque to detent 26 moving detent 26 toward fork bolt 24 with the movement decelerating as the two springs expand and reduce their respective applied torques. Auxiliary helper spring 148 engages stop 33 before detent 26 strikes fork bolt 24. Detent 26 then decelerates rapidly because the torque acting on detent 26 is diminished to the torque produced by main spring 32. Thus detent 26 strikes fork bolt 28 with relatively little speed and force thereby providing a substantially quiet operation.

Both helper spring 148 and main detent spring 32 engage ear 27 and are compressed to a maximum extent when detent 26 is in the release position and fork bolt is in the disengaged position as shown in FIG. 6. Thus in the second embodiment, the high torque of the main detent spring 32 and the auxiliary helper spring 148 initiates movement of the detent 26 toward detent position of FIG. 5 so that the door latch 10 with the modified auxiliary detent spring 148 can also operate in harsh environments, for instance, corrosive environments and/or cold environments up to −50 degrees centigrade. Overall unlatching effort is also reduced as before because, detent 26 does not encounter the resistence of the auxiliary detent spring 148 when moving from the detent position of FIG. 5 to the release position of FIG. 6 until the auxiliary detent spring 148 is engaged after the detent 26 has moved some distance.

Many modifications and variations of the present invention in light of the above teachings may be made. It is, therefore, to be understood that, within the scope of the appended claims, the invention may be practiced otherwise than as specifically described.

We claim:

1. A vehicle door latch having a forkbolt that has a movement between a latched position and an unlatched position, a detent that has a movement between a release position and a detent position, the detent engaging and holding the forkbolt in the latched position when the detent is in the detent position, the detent releasing the forkbolt for movement to the unlatched position when the detent is in the release position, a detent spring biasing the detent toward the detent position, and a release mechanism for moving the detent against the bias of the detent spring to the release position to release the forkbolt, characterized in that:

the vehicle door latch includes an auxiliary spring that acts on the detent for a greater portion of the movement of the detent between the release position and the detent position to produce a torque on the detent that diminishes at different rates as the detent moves from the release position to the detent position, the auxiliary spring being a counter spring that biases the detent toward the release position and away from the detent position after an initial portion of the movement of the detent between the release position and the detent position.

2. A vehicle door latch having a forkbolt that moves between a latched position and an unlatched position, a detent that moves between a detent position and a release position, the detent engaging and holding the forkbolt in the latched position when the detent is in the detent position, the detent releasing the forkbolt for movement to the unlatched position when the detent is in the release position, a detent spring biasing the detent toward the detent position, and a release mechanism for moving the detent against the bias of the detent spring to the release position to release the forkbolt, characterized in that:

the vehicle door latch includes a detent counter spring for biasing the detent toward the release position, the detent counter spring acting on the detent for a greater portion of the movement of the detent between the release position and the detent position to produce a torque on the detent that diminishes at different rates as the detent moves from the release position to the detent position.

3. A vehicle door latch having a forkbolt that moves between a latched position and an unlatched position, a detent that moves between a detent position and a release position, the detent engaging and holding the forkbolt in the latched position when the detent is in the detent position, the detent releasing the forkbolt for movement to the unlatched position when the detent is in the release position, a detent spring biasing the detent toward the detent position, and a release mechanism for moving the detent against the bias of the detent spring to the release position to release the forkbolt, characterized in that:

the vehicle door latch includes a detent counter spring for biasing the detent toward the release position, and the detent has a stroke or distance of travel as the detent moves from the release position to the detent position and wherein the counter spring is a coil shaped compression spring that engages the detent for a substantial part of the stroke.

4. The vehicle door latch according to claim 3 wherein the detent counter spring is disposed in a slot of the housing, the detent counter spring having one end engaging the detent and an opposite end engaging a wall of the slot.

5. The vehicle door latch according to claim 3 wherein the detent counter spring is spaced from the detent when the detent is in the release position.

6. The vehicle door latch according to claim 4 wherein the detent counter spring is spaced from the detent when the detent is in the release position.

7. The vehicle door latch according to claim 5 wherein the detent counter spring is stressed when the detent is in the latched position.

8. The vehicle door latch according to claim 6 wherein the detent counter spring is stressed when the detent is in the latched position.

9. A vehicle door latch having a forkbolt that moves between a latched position and an unlatched position, a detent that pivots between a detent position and a release position, the detent engaging and holding the forkbolt in the latched position when the detent is in the detent position, the detent releasing the forkbolt for movement to the unlatched position when the detent is in the release position, a detent spring biasing the detent toward the detent position, and a release mechanism for moving the detent against the bias of the detent spring to the release position to release the forkbolt, characterized in that:

the vehicle door latch includes a detent counter spring for biasing the detent toward the release position, the detent spring applying a torque to the detent in a direction and the detent counter spring applying a counter torque to the detent in an opposite direction for a greater portion of the pivotal movement of the detent from the release position to the detent position.

10. A vehicle door latch having a forkbolt that moves between a latched position and an unlatched position, a detent that pivots between a detent position and a release position, the detent engaging and holding the forkbolt in the latched position when in the detent position, the detent releasing the forkbolt for movement to the unlatched position when the detent is in the release position, a detent spring biasing the detent toward the detent position, and a release mechanism for moving the detent against the bias of the detent spring to the release position to release the forkbolt characterized in that:

the vehicle door latch includes a detent counter spring for biasing the detent toward the release position, the detent spring applies a torque to the detent, the detent counter spring applies a counter torque to the detent, the detent has a pivot, the detent spring engages the detent on one side of the pivot, and the detent counter spring is a coil shaped compression spring that engages the detent on an opposite side of the pivot for a substantial distance of travel as the detent moves from the release position to the detent position.

11. The vehicle door latch according to claim 10 wherein the detent counter spring is disposed in a slot of the housing, the detent counter spring having one end engaging the detent and an opposite end engaging a wall of the slot.

12. The vehicle door latch according to claim 11 wherein the detent counter spring is spaced from the detent when the detent is in the release position.

13. The vehicle door latch according to claim 12 wherein the detent counter spring is stressed when the detent is in the latched position.

14. A vehicle door latch having a forkbolt that has a movement between a latched position and an unlatched position, a detent that has a movement between a release position and a detent position, the detent engaging and holding the forkbolt in the latched position when in the detent position, the detent releasing the forkbolt for movement to the unlatched position when the detent is in the release position, a detent spring biasing the detent toward the detent position, and a release mechanism for moving the detent against the bias of the detent spring to the release position to release the forkbolt, characterized in that:

the vehicle door latch includes a helper spring for biasing the detent toward the detent position, the helper spring being coaxial with the detent spring and engaging the detent when in the release position and disengaging from the detent before the detent reaches the detent position.

15. The vehicle door latch according to claim 14 wherein the helper spring is disposed in a slot of the housing, the auxiliary spring having one end engaging the detent and an opposite end engaging a wall of the slot when the detent is in the release position.

16. The vehicle door latch according to claim 14 wherein the helper spring is spaced from the detent when the detent is in the detent position.

17. The vehicle door latch according to claim 15 wherein the helper spring is spaced from the detent when the detent is in the detent position.

18. A vehicle door latch having a forkbolt that has a movement between a latched position and an unlatched position, a detent that has a movement between a release position and a detent position, the detent engaging and holding the forkbolt in the latched position when in the detent position, the detent releasing the forkbolt for movement to the unlatched position when the detent is in the release position, a detent spring biasing the detent toward the detent position, and a release mechanism for moving the detent against the bias of the detent spring to the release position to release the forkbolt, characterized in that:

the vehicle door latch includes a helper spring for biasing the detent toward the detent position, the auxiliary spring engaging the detent when in the release position and disengaging from the detent before the detent reaches the detent position, the helper spring is disposed in a slot of the housing, the auxiliary spring having one end engaging the detent and an opposite end engaging a wall of the slot when the detent is in the release position, the helper spring is spaced from the detent when the detent is in the detent position, and the helper spring is coaxial with the detent spring.

* * * * *